US005355947A

United States Patent [19]

Rasso, Jr. et al.

[11] Patent Number: 5,355,947

[45] Date of Patent: Oct. 18, 1994

[54] HEAT EXCHANGER HAVING FLOW CONTROL INSERT

[75] Inventors: Steven J. Rasso, Jr., Kettering, Ohio; Stephane Petit, LeMans; Jean P. Herve, Mesnil Sauin Denis, both of France

[73] Assignee: Chrysler Corporation, Highland Park, Mich.

[21] Appl. No.: 140,835

[22] Filed: Oct. 25, 1993

[51] Int. Cl.[5] ..... F28D 1/03

[52] U.S. Cl. ..... 165/176; 165/153; 165/178

[58] Field of Search ..... 165/153, 176, 178

[56] References Cited

U.S. PATENT DOCUMENTS 4,487,038 12/1984 Iijima ..... 62/515
4,821,531 4/1989 Yamauchi et al. ..... 62/515

FOREIGN PATENT DOCUMENTS 1-181090 7/1989 Japan ..... 165/153

*Primary Examiner*—Allen J. Flanigan
*Attorney, Agent, or Firm*—Kenneth H. MacLean

[57] ABSTRACT

A multi-pass U-flow type evaporator for an air conditioning system provided with a flow control insert which allows the inlet port and the outlet port to be located on the same face of the evaporator core and in close proximity to each other.

7 Claims, 2 Drawing Sheets

HEAT EXCHANGER HAVING FLOW CONTROL INSERT

This invention concerns heat exchangers and more particularly relates to a heat exchanger of the type that can be utilized as an evaporator in an automobile air conditioning system and in which the inlet port and the outlet port of the evaporator can be located on the same side of the evaporator core and in close proximity to each other.

BACKGROUND OF THE INVENTION

As is well known, the evaporator of an automobile air conditioning system is normally combined with the usual components which provide heated and ventilated air to the interior of the automobile. The unit incorporating such components is made as a module type assembly which is attachable to the fire wall of the vehicle and includes a housing supporting the heater core, evaporator, and the blower within suitable duct work provided with valves for directing air flow through the evaporator and/or the heater core and into the vehicle interior. Thus, by operation of a heater/air conditioning control unit located on the instrument panel, the driver can selectively provide heated, cooled, or outside air into the passenger compartment of the automobile.

Inasmuch as the heater core and the evaporator core have fluid flowing therethrough, a pair of pipes are connected to each for allowing the fluid to enter and leave the core. In this regard, it has been found that in certain U-flow evaporator designs difficulties can be encountered in providing sufficient space for routing the piping of both of the cores within and without the support casing. This is particularly true when the evaporator has the refrigerant inlet located long one side of the evaporator core and the outlet located at the front end of the core. In this form of the evaporator, long pipes are required for connection with the other components of the system. One form of evaporator design which requires the inlet and outlet ports be so located is the so-called six pass design wherein the refrigerant flows into three blocks of U-flow tubes for reversing the direction of flow and passes in front of the blower forced air six times. In certain vehicles, it would be advantageous to locate the inlet and outlet ports of the six pass evaporator internal to the tube sections for packaging reasons, but presently it is not possible to do so.

SUMMARY OF THE INVENTION

Accordingly, the objects of the present invention are to provide a new and improved multi-pass U-flow type evaporator for an air conditioning system in which the inlet port and the outlet port are located on the same face of the evaporator core and in which the fluid flow in the first block of U-flow tubes is divided into two separate streams which combine at and cross the inlet port for further flow to the adjoining block of the U-flow tubes of the evaporator; to provide a new and improved evaporator having a plurality of U-flow type tubes arranged side by side and in which a flow control insert is connected to the forward tank portion and the rear tank portion of a pair of the tubes and is located between the pair of tubes so as to allow pressurized refrigerant to initially flow to the rear tank portions of the pair of tubes and be to divided at the rear tank portions into two streams flowing in opposed directions and afterwards causes the two streams to combine for further flow into adjoining tubes of the evaporator; to provide a new and improved evaporator having a plurality of U-flow type tubes arranged side by side and provided with a flow control insert which is formed with an inlet port for receiving pressurized refrigerant and which has a pair of opposed openings for directing the refrigerant initially in opposed directions into adjacent tubes and is also formed with a third opening which allows the refrigerant in the tubes along one side of the insert to cross over into the tubes located on the other side of the insert; to provide a new and improved evaporator for an automobile air conditioning system that is a six pass design and has both the inlet port and the outlet port for the pressurized refrigerant located on the same face of the evaporator core; and to provide a new and improved evaporator having a flow control insert located between a pair of U-flow tubes and in which the insert is provided with an elongated body portion which permits incoming pressurized refrigerant to flow through the body portion from the face of the evaporator to the rear tank portions of the pair of tubes and afterwards allows the two streams to be combined at the front tank portions of the pair of tubes by having one of the streams flow through a cross flow opening formed in the insert.

The above and other objects and advantages are realized in accordance with the invention by a multi-pass evaporator which has a plurality of tube units operatively interconnected with one another to transmit pressurized fluid therethrough. Each of the tube units provide U-type flow for the pressurized fluid and one end of each of the tube units is formed with a front tank portion and a rear tank portion. One of the tank portions serves as a inlet tank for the pressurized fluid and the other of the tank portions serves as an outlet tank for the pressurized fluid. A flow control insert is located between a pair of the tube units and is formed with a body portion having a fluid inlet port for initially receiving the pressurized fluid. In the preferred form, the body portion also includes a first opening and a second opening for simultaneously connecting the inlet port through the body portion with the rear tank portions of each of the pair of tube units so as to divide the pressurized fluid into two separate streams which flow on opposed sides of the flow control insert. In addition, the body portion is formed with a third opening located adjacent the inlet port that permits one of the streams at one side of the flow control insert to flow through the third opening and be combined with the stream on the other side of the flow control insert for further flow into adjoining tube units of the evaporator.

A more complete understanding the present invention will be apparent from the following detailed description when taken with the drawings in which:

DETAILED DESCRIPTION OF THE PREFERRED EMBODIMENT

Figure 2:
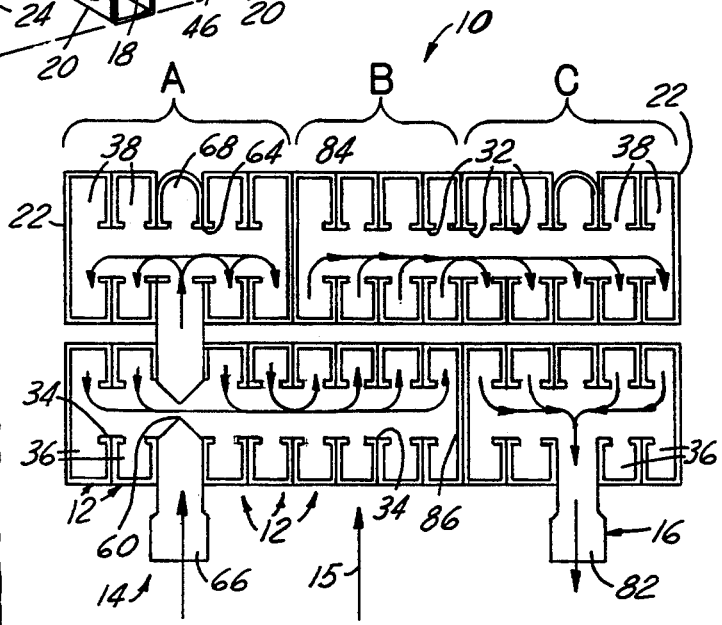
FIG. 2 is a schematic top view diagram showing the six pass evaporator provided with three blocks of U-flow tubes interconnected for allowing refrigerant flow from an inlet port to the outlet port.

Referring now to the drawings and more particularly FIG. 2 thereof, a six pass evaporator 10 according to the present invention is shown of the type that can be utilized with an automotive air conditioning system. As seen in FIG. 2, the evaporator core 10 includes three blocks, identified by the letters A, B, and C, each of which is composed of a plurality of the U-flow tubes 12 which are connected with one another to provide a serpentine flow path for the pressurized refrigerant.

In this instance and as seen in the schematic diagram of FIG. 2, the pressurized liquid refrigerant leaving the expansion valve (not shown) enters block A of the evaporator 10 via a flow control insert 14, initially flows (as indicated by the arrows) to the rear of the evaporator 10 and then to the front thereof. This flow provides the first two passes of the refrigerant relative to the blower-forced air flow indicated by the arrow 15 that passes through the evaporator. The refrigerant then leaves block A and enters block B at the front of the evaporator and flows to the rear thereof. This refrigerant flow in block B provides the third and fourth passes of the refrigerant relative to the air flow through the evaporator. The refrigerant leaves block B and enters block C at the rear of the evaporator and flows to the front thereof and finally exits the evaporator via an outlet insert 16 provided in the front portion of the evaporator. As the refrigerant flows through block C from the rear to the front of the evaporator core, the refrigerant completes the fifth and sixth pass relative to the air flow. As is well known, the pressurized refrigerant enters the evaporator in a liquid state and as it flows through blocks A, B, and C, it is warmed by the air passing throughout the evaporator. As more heat from the passenger compartment is absorbed by the U-flow tubes 12, the refrigerant begins to boil and by the time it completes the six passes and reaches the outlet insert 16, the refrigerant is vaporized.

Figure 1:
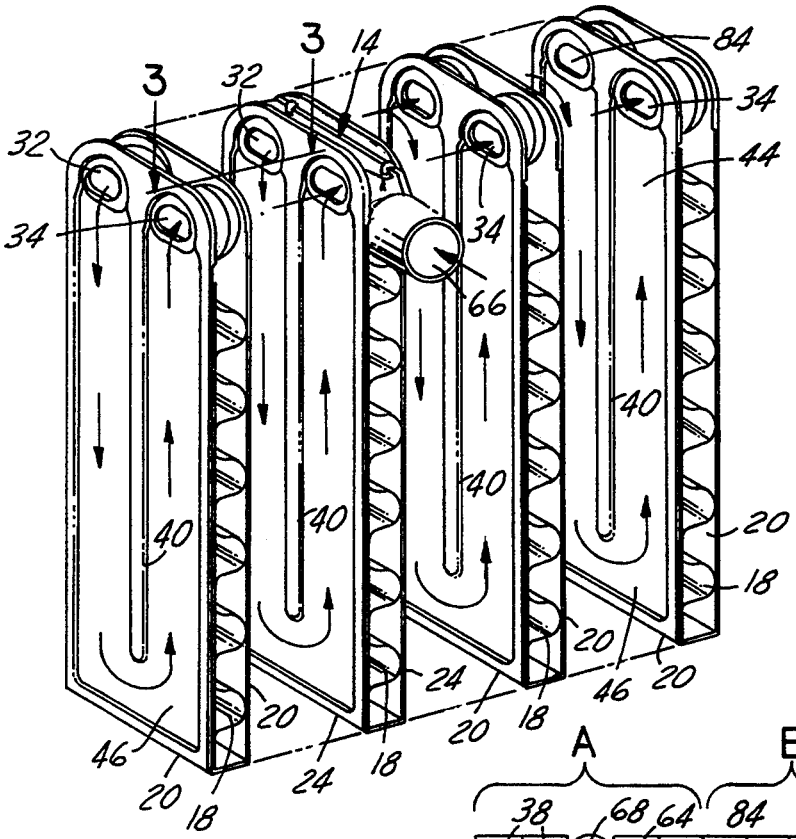
FIG. 1 is perspective view showing in separated form a part of the first block of U-flow type tubes of a six pass evaporator combined with a flow control insert in accordance with the present invention.
Figure 3:
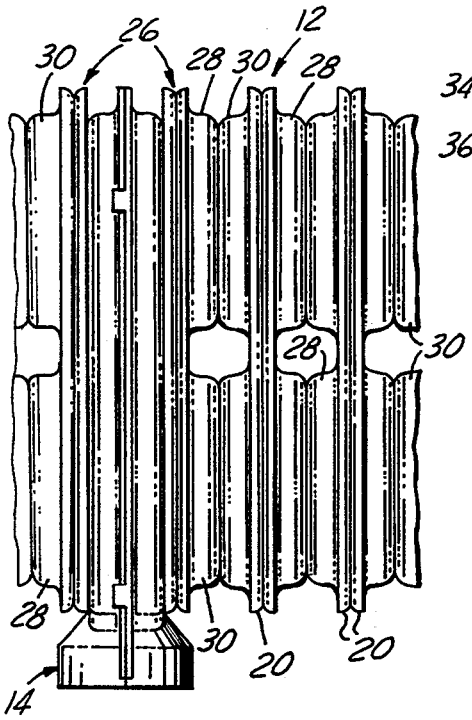
FIG. 3 is an enlarged plane view showing the plate portions of the U-flow tubes of FIG. 1 joined together with the flow control insert.
Figure 4:
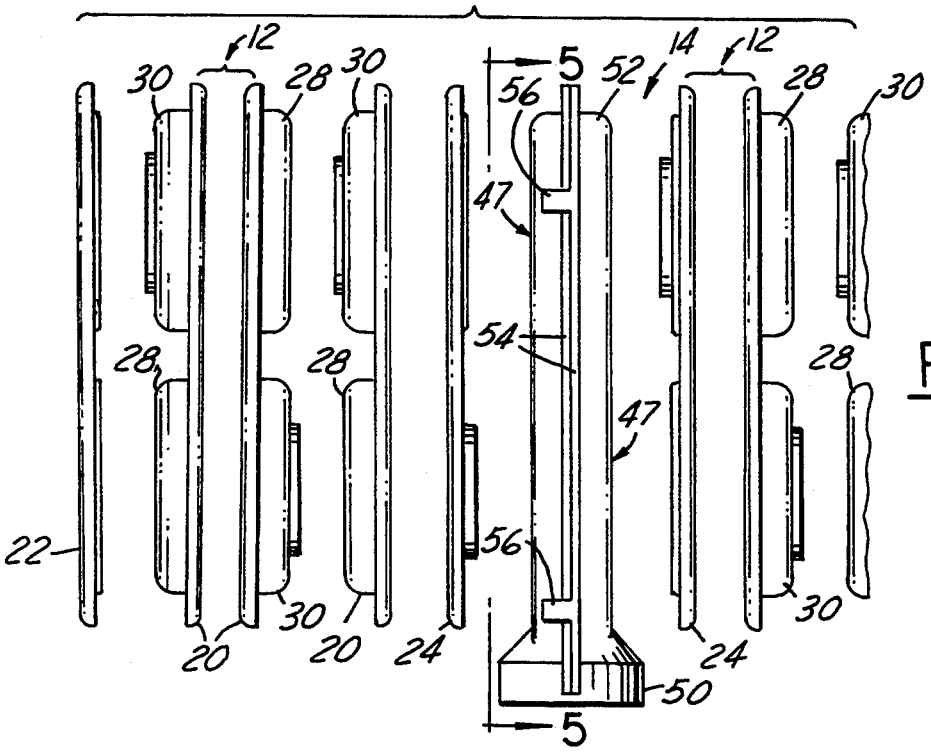
FIG. 4 is a plane view of the separated plates of the U-flow tubes located adjacent to the flow control insert.

As mentioned above, each of the blocks A, B, and C include a plurality of interconnected U-flow tubes 12. As seen in FIGS. 1 and 4, the ports forming each tube A are shown separated from each other while FIG. 3 shows the parts joined together with the flow control insert 14. The tubes 12 are connected to each other at their upper and lower ends and are arranged so as to define spaces between adjacent tubes 12 that accommodate corrugated cooling fins 18, as seen in FIG. 1. The fins 18 are fixed between each pair of adjacent tubes 12 and are formed of thin sheets of aluminum or other suitable metal and serve to increase the heat transfer performance of the evaporator 10. Thus, as the blower forced air flows through the space occupied by the fins 18, the air loses heat energy to the refrigerant circulating through the tubes 12 causing the refrigerant to boil and vaporize and be discharged via the outlet insert 16 thereby cooling the interior of the automobile passenger compartment.

As is conventional, each of the tubes 12 is fabricated from a pair of substantially flat plates 20. Also, except for the end plates 22 and the plates used to form the tubes 26 located at the opposite sides of the flow control insert 14 and the opposite sides of the outlet insert 16, the plates are substantially identical to one another. Thus, as seen in FIGS. 1, 3, and 4, each of the plates 20 has a pair of side by side oval protuberances 28 and 30 formed at the upper end thereof. The protuberances 28 and 30 define oval openings 32 and 34 respectively so when the tubes are stacked into a core, the protuberances 28 interconnect with protuberances 30 by shouldered openings so that adjacent tubes are coupled together and spaced at their upper ends. The interconnected protuberances 28 and 30 define a pair of tank portions 36 and 38 of the core located at the upper end of each of the tubes 12. In this instance, and as seen in FIG. 2, the tube portions are shown schematically and the tank portion 36 will hereinafter be referred to as the front tank and the tank portion 38 will be referred to as the rear tank. As will become apparent as the description of the invention proceeds, depending upon the block A, B, or C in which the front tank 36 and rear tank 38 is located, will determine if the tank serves as a fluid inlet tank or fluid outlet tank.

In addition, as seen in FIG. 1, each of the plates 20 and 24 is formed with an elongated inwardly projecting divider rib 40. The divider rib 40 of each plate extends longitudinally downwardly from the upper end of the plate slightly more that three quarters of the length of each plate for brazed connection to the corresponding rib 40 of a mating plate. The divider rib 40 defines side flow sections 42 and 44 and a cross over section 46 at the bottom of the plate and serves as a partition in the tube so that the refrigerant is forced to follow the U-shaped path, shown by the arrows in FIG. 1, through each tube at it flows from the rear tank 38 to the front tank 36 of block A. Although not shown, each side section 42 and 44 of each plate is also formed with a pattern of inwardly extending dimples and short embossed ribs. Thus, when the plates 20 are brazed together, the dimples and embossed ribs are connected at interfacing contract points to provide for optimized mechanical strength and varying serpentine flow paths through each tube 12 as the refrigerant follows the U-shaped path for effective transfer of heat energy between the refrigerant and the air flowing through the evaporator 10.

The flow control insert 14 which forms a part of block A of the evaporator 10 can best be seen in FIGS. 4–8. In this regard, the flow control insert 14 is formed by a pair of identical aluminum members each of which includes an elongated flat body portion 48 one end of which terminates with a semi-circular section 50. A wall 52 is integrally formed with and surrounds the body portion 48 starting at the top portion of the semi-circular section 50 and ending at the bottom portion of the semi-circular section 50. A flange 54 is integrally formed with the wall 52 and lies in a plane which is generally parallel to the plane of the body portion 48. A straight section of the flange 54 along one elongated side of the body portion 48 has a pair of spaced tabs 56 formed therewith one of which is located adjacent to the semi-circular section 50 and the other adjacent to the other end of the body portion 48. An oval depression or well 58 is formed in the body portion 48 adjacent the semi-circular section 50 and extends in the same direction as the wall 52. The well 58 has an oval opening 60 formed therein that is surrounded by rim 62 which lies in the plane of the flange 54. In addition, a second oval opening 64 is formed in the body portion 48 in axial alignment with the opening 60 in the well 58.

By joining a pair of the members 47 together in confronting relation as seen in FIGS. 5–8, the flange 54 of one of the members 47 engages the corresponding flange 54 of the other member 47 and at the same time the rims 62 of the two members engage each other. The tabs 56 are then bent over for maintaining the two members 47 in proper relative positions during the brazing operation. Thus, once the two members 47 are joined together through the brazing operation, the flow control insert 14 is formed so as to provide an inlet port 66 at one end which connects with a chamber 68 so that fluid can flow from the inlet port 66 and then above and below the opening 60 (indicated by the arrows in FIG. 5) and exit through both openings 64.

It will be noted that the flow control insert 14 is intended to be located at a point internal of block A. Thus, as seen in FIGS. 1, 3, and 4, the flow control insert 14 is located midway between the tubes 12 which form block A and the openings 60 and 64 therein register with the opening 34 and 32 respectively of the tubes 12. Proper mating of the flow control insert 14 with the tubes 12 on opposed sides of the flow control insert 14 is realized through the plates 24 which in all respects are identical to the plates 20 except that the tank portions of the plates 24 are of less depth than the tank portions formed in plates 20.

Figure 9:
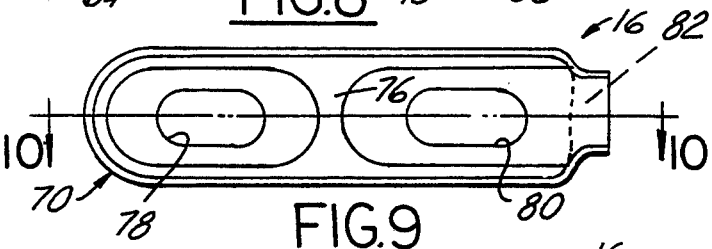
FIG. 9 is a side elevational view of the outlet insert employed with the evaporator seen in FIG. 2.
Figure 10:
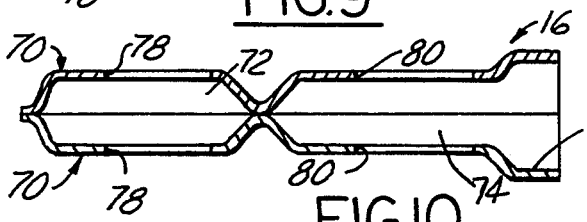
FIG. 10 is a cross sectional view taken on line 10—10 of FIG. 9.

The outlet insert 16 which forms a part of block C can be seen in FIGS. 9 and 10 and, as in the case with the flow control insert 14, is formed by two identical members 70 joined together. It differs from the flow control insert 14 in that it has two separate chambers 72 and 74 which are spaced axially from each other and which do not communicate with each other. The body portion 76 of each member 70 of the outlet insert 16 is formed with a pair of axially spaced openings 78 and 80, the former of which provides cross flow for fluid through the chamber 72 and the latter of which provides cross flow through chamber 74. Also, when joined together, the members 70 define an outlet port 82 which allows the refrigerant to exit the evaporator 10.

As best seen in FIG. 2, the evaporator 10 has each end thereof provided with the end plate 22 which serves to close off the first tube 12 and the last tube 12 of the evaporator 10. The end plate 22 which connects with the first tube 12 of block A can be seen in FIG. 4. It will be noted that in order to show the flow paths of the refrigerant, block A seen in FIG. 1 does not show the end plate 22 or the adjoining plate 20 of the first tube seen in FIG. 4.

When the plates 20–24, cooling fins 18, flow control insert 14, and the outlet insert 16 are assembled and brazed together so as to form the core of evaporator 10 seen in FIG. 2, the front tanks 36 and the rear tanks 38 of the various tubes of the assembly will communicated with each other in the manner illustrated in FIG. 2. It will be noted that in order to allow the refrigerant to reverse its direction of flow as it leaves block A and enters block B, the usual opening in the rear tank between the fourth tube and the fifth tube (counting from the left as seen in FIG. 2) is closed by a wall 84 as seen in FIG. 1. A similar wall 86 closes the opening in the front tank between the eighth and ninth tube so as to reverse the direction of flow of the refrigerant as it leaves block B and enters block C.

In the current design of six pass type evaporators, the inlet port would normally be connected directly to the rear tank 38 of the first tube of block A. In other words, as seen in FIG. 2, the inlet port would be located on the left side of the evaporator 10 and connected through the end plate 22 to the rear tank 38. As alluded to hereinbefore, by having the inlet port at the side of the evaporator, one can encounter problems of space availability for the piping as well as lack flexibility as to the positioning of the evaporator within the module mounted on the fire wall of the automobile. This problem is eliminated in accordance with the present invention by utilizing the flow control insert 14 described above which permits the inlet port to be located on the same face as the outlet port and still permit the refrigerant to have the six pass flow through the evaporator.

Figure 5:
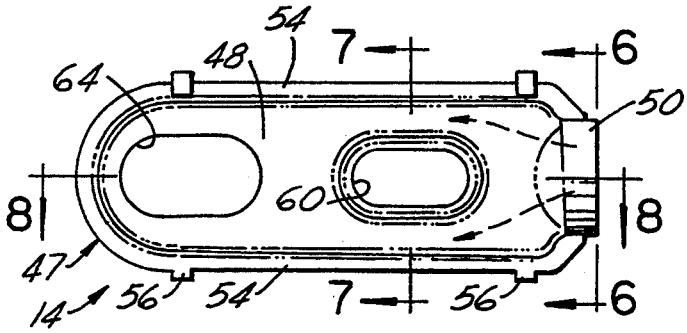
FIG. 5 is a side elevational view of the flow control insert taken on line 5—5 of FIG. 4.
Figure 6:
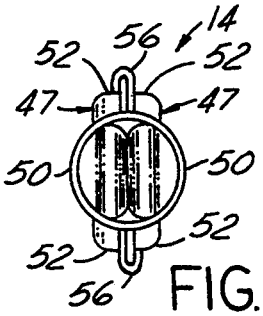
FIG. 6 is an end view of the flow control insert taken on line 6—6 of FIG. 5.
Figure 8:
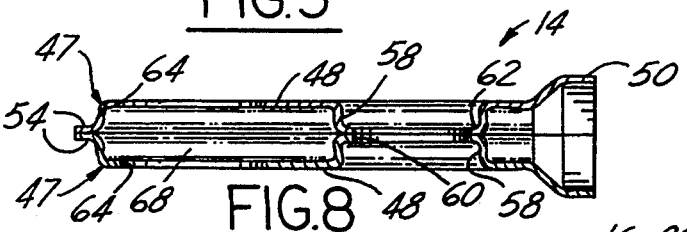
FIG. 8 is a sectional view of the flow control insert taken on line 8—8 of FIG. 5.
Figure 7:
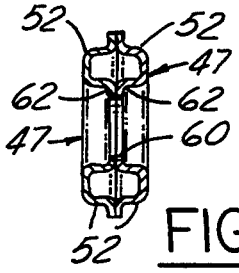
FIG. 7 is a sectional view of the flow control insert taken on line 7—7 of FIG. 5.

In this regard, the present invention operates as follows: As the pressurized refrigerant enters block A of the evaporator 10 via the inlet port 66 provided in the flow control insert 14 as seen in FIGS. 1 and 2, the refrigerant flows as seen in FIG. 5 above and below the wells 58 and exists through the openings 64 which communicate with the rear tanks 38 of the tubes 12 of block A. As the refrigerant exits the openings 64 of the flow control insert 14, the refrigerant is divided into two streams flowing in opposed directions to fill the rear tanks 38 of the four tubes 12 of block A which communicate with each other through the openings 32. From the rear tanks 38 of the tubes 12 of block A and because of the divider rib 40 providing for the U-type flow as well as because of the wall 84 between the fourth and fifth tubes, the refrigerant flows downwardly and then upwardly (as shown by arrows in FIG. 1) within each of the tubes and then into the front tanks 36 seen in FIG. 2. Inasmuch as the front tanks 36 communicate with each other through the openings 34 provided in the tubes 12 of block A and block B, the refrigerant then flows through the opening 34 of the fourth tube into the front tanks 36 of the tubes 12 located in block B. In this regard, it will be noted that the refrigerant flowing in the first two tubes 12 of block A is able to combine with the refrigerant flowing through the third and fourth tubes 12 because of the opening 60 provided in the flow control insert 14. Thus, the flow control insert 14 allows the two streams located in the tubes 12 at the opposed sides of the flow control insert 14 to join together for further flow into the adjoining tubes 12 in block B.

After entering the front tanks 36 of the tubes 12 in block B and again because of the divider ribs 40 provided in the tubes 12 of block B and the wall 86 located between the eighth and ninth tube, the refrigerant then flows downwardly and then upwardly to the rear tanks 38 of the tubes 12 of block B. The refrigerant then exists block B and enters the rear tanks 38 of block C. The refrigerant enters the rear tanks 38 of the last two tubes 12 of block C by passing through the openings 78 of the outlet insert 16. The refrigerant flows downwardly and then upwardly into the front tanks 36 of the tubes 12 of block C and finally flows into the openings 80 of the outlet insert 16 and exits the evaporator via outlet port 82. The vaporized refrigerant then flows to the compressor (not shown) which compresses the low pressure refrigerant vapor into a high pressure, high temperature vapor for circulating back to a condenser and then back to the evaporator to complete a basic cycle for cooling the interior of the automobile.

It will be understood by those skilled in the art that although the flow control insert 14 is shown providing the inlet port for the refrigerant passing through the evaporator 10, the flow control insert 14 could reverse its role and serve as an outlet for the refrigerant. This could be accomplished by having the refrigerant enter the evaporator 10 as seen in FIG. 2 through the outlet insert 16 which would then require that the flow control insert 14 serve as the outlet. Also, although the flow control insert 14 is shown used with a six pass evaporator, it could also be used with a four pass evaporator by locating a second flow control insert in block B between the sixth and seventh tubes, removing block C and replacing the latter with an end plate. In addition, it should be apparent to those skilled in the art that more than four tubes 12 can be placed in each of the blocks A, B, and C. The number of tubes 12 in each block will depend upon the cooling capacity of the air conditioning system and on the design requirements and space availability for the piping.

Various changes and modifications can be made in the above described construction without departing from the spirit of the invention. Such changes and modifications are contemplated by the inventors and they do not wish to be limited except by the scope of the appended claims.

The embodiments of the invention in which an exclusive property or privilege is claimed are defined as follows:

1. In a multi-pass evaporator comprising a plurality of tube units operatively interconnected with one another to transmit pressurized refrigerant therethrough, each of said tube units providing a U-type flow for said pressurized refrigerant, one end of each of said tube units being formed with a pair of spaced tanks between which the pressurized refrigerant flows as it passes through the separate tube units, said plurality of tubes being arranged in separate blocks so that the direction of flow of the pressurized refrigerant between said pair of tanks is reversed as said pressurized fluid passes from one of said blocks to the adjoining block, one of said blocks having an inlet port for receiving said refrigerant in a liquid state and another of said blocks having an outlet for having said refrigerant exit said evaporator in a vaporized state, the improvement wherein a flow control insert is located in one of said blocks and has a body portion engaging with one of said ports, wherein said body portion of said flow control insert is elongated and is adjacent to said tube unit and has said one of said ports located at one end thereof, the other end of said body portion of said flow control insert having a chamber which communicates with said one of said ports and allows said refrigerant to flow therebetween along the longitudinal axis of said flow control insert, and a third opening being located between said chamber and said one of said ports and allowing said refrigerant to flow in a direction crossing said longitudinal axis, said flow control insert being located between a pair of said tube units and having a first opening and a second opening communicating with said one of said ports and being connected to one of said tanks of each of said pair if tube units for allowing two separate streams of said refrigerant to flow through said body portion, and said body portion having a third opening formed therein that communicates with the other of said tank portions of said pair of tubes so that one of said two separate streams of refrigerant flows through said third opening and is combined with the other of said two separate streams so as to allow said outlet port and said inlet port to be located on the same face of said evaporator.

2. The multi-pass evaporator set forth in claim 1 wherein said flow control insert comprises a pair of identical members which are brazed together.

3. The multi-pass evaporator set forth in claim 2 wherein each of said members has a depressed section therein provided with said third opening.

4. The multi-pass evaporator set forth in claim 3 wherein said depressed section is located adjacent said one of said ports.

5. The multi-pass evaporator set forth in claim 4 wherein said depressed section defines passages above and below said third opening that allow said refrigerant to flow from said one of said ports directly to said chamber and vice versa.

6. The multi-pass evaporator set forth in claim 5 wherein each of said members of said flow control insert has a flange formed with a pair of tabs which serve to maintain said members in proper position during a brazing operation.

7. The multi-pass evaporator set forth in claim 6 wherein said first and second openings serve to connect said chamber with said one of said tanks of each of said pair of tube units.

* * * * *